US007150562B2

(12) United States Patent
Hansen et al.

(10) Patent No.: US 7,150,562 B2
(45) Date of Patent: Dec. 19, 2006

(54) HIGH VOLTAGE CABLE TERMINAL AND CLAMP SYSTEM

(75) Inventors: Wayne R. Hansen, Centerville, UT (US); Paul G. Christean, Salt Lake City, UT (US); Ricky Smith, Sandy, UT (US)

(73) Assignee: Finisar Corporation, Sunnyvale, CA (US)

( * ) Notice: Subject to any disclaimer, the term of this patent is extended or adjusted under 35 U.S.C. 154(b) by 0 days.

(21) Appl. No.: 10/937,150

(22) Filed: Sep. 9, 2004

(65) Prior Publication Data

US 2006/0050853 A1 Mar. 9, 2006

(51) Int. Cl.
*H05G 1/00* (2006.01)

(52) U.S. Cl. ..... 378/204; 378/121; 439/367

(58) Field of Classification Search ..... 378/101, 378/119, 121, 204; 439/279, 367, 588
See application file for complete search history.

(56) References Cited

U.S. PATENT DOCUMENTS

| | | | | |
|---|---|---|---|---|
| 4,335,928 | A | 6/1982 | Barrett et al. | 439/519 |
| 4,362,348 | A | 12/1982 | Stephenson et al. | 439/258 |
| 4,494,811 | A | 1/1985 | Palermo, Jr. | 439/271 |
| 4,767,961 | A | 8/1988 | Koller et al. | 313/12 |
| 4,799,248 | A | 1/1989 | Furbee et al. | 378/114 |
| 4,806,113 | A | 2/1989 | Rate et al. | 439/190 |
| 5,145,402 | A | 9/1992 | Plyler et al. | 439/459 |
| 5,154,638 | A | 10/1992 | Sireul et al. | 439/611 |
| 5,162,267 | A | 11/1992 | Smyth | 501/45 |
| 5,310,361 | A | 5/1994 | Muchowicz et al. | 439/610 |
| 5,358,419 | A | 10/1994 | Pejsa et al. | 439/201 |
| 5,384,820 | A | 1/1995 | Burke | 378/135 |
| 5,553,114 | A | 9/1996 | Siemers et al. | 378/129 |
| 5,707,252 | A | 1/1998 | Meszaros | 439/610 |
| 6,140,582 | A | 10/2000 | Sheehan | 174/65 G |
| 6,198,802 | B1 | 3/2001 | Elliott et al. | 378/119 |
| 6,213,805 | B1 | 4/2001 | Jedlitschka et al. | 439/271 |
| 6,556,654 | B1 * | 4/2003 | Hansen et al. | 378/101 |
| 6,816,574 | B1 | 11/2004 | Hansen | 378/121 |

* cited by examiner

*Primary Examiner*—Courtney Thomas
(74) *Attorney, Agent, or Firm*—Workman Nydegger

(57) ABSTRACT

A cable terminal and clamp system particularly suited for use in an x-ray tube environment. The cable terminal and clamp system includes a cable socket having cable and terminal ports, each of which defines an axis. The cable terminal and clamp system includes a cable clamp that receives at least a portion of the cable socket. The cable clamp and cable socket are configured so that motion of the cable socket, relative to the cable clamp, along the axis defined by the terminal port is unimpaired, while motion of the cable socket, relative to the cable clamp, along the axis defined by the cable port is precluded. A spring interposed between the cable socket and cable clamp biases the cable socket away from the cable clamp along the axis defined by the terminal port. The cable terminal and clamp system thus accommodates thermal expansion of the terminal, while retaining the terminal in an associated receptacle and maintaining alignment of the cable clamp and cable socket.

30 Claims, 12 Drawing Sheets

110B
102A
104
102
104
106A
110A 110B
102B
102A
102
102B
110A
110B
102B
102
110A 104
102
106B
108
106A

HIGH VOLTAGE CABLE TERMINAL AND CLAMP SYSTEM

BACKGROUND OF THE INVENTION

1. Related Applications

Not applicable.

2. Field of the Invention

The present invention relates generally to x-ray systems, devices, and related components. More particularly, example embodiments of the invention concern a high voltage cable clamp system configured to facilitate and maintain a cable terminal in a desired position and alignment relative to an associated receptacle, over a range of operating conditions.

Related Technology

The various components employed in x-ray tubes and other high temperature, high-voltage applications are typically required to operate consistently and reliably under extreme conditions for sustained periods of time. In the case of an x-ray device for example, high speed rotation of the anode may cause the x-ray device to vibrate, so that components of the x-ray device become misaligned over a period of time. Such vibrations may also adversely affect the mechanical connections within the x-ray device. For example, arcing typically results when cable terminals separate, even slightly, from the associated receptacle.

X-ray devices are also subjected to extreme thermal conditions. For example, the generation of x-rays, which generally involves accelerating electrons at high speed to a target surface on an anode, can result in operating temperatures as high as 1300° C. Not only are such components routinely exposed to high operating temperatures, but such components are often subjected to extreme thermal cycles as well. For example, x-ray devices are typically reach a required operating temperature within a time span of just a few minutes. Thus, the rate of change of temperature with respect to time is relatively great. The thermal stresses imposed by such steep temperature gradients often have various destructive or detrimental effects on the structure and performance of the components of the device.

Thermal and mechanical effects, including those discussed above, can cause a variety of problems. As discussed below, such effects are of particular concern with regard to the positioning, alignment and performance of high voltage cables and associated devices and equipment that are employed in connection with high voltage equipment such as x-ray devices.

Typically, such high voltage cables include a terminal attached to a cable having one or more electrical conductors electrically isolated from each other and wrapped in a protective covering or sheath. The terminal includes a conical rubber terminal element that is configured and arranged to be closely received within a correspondingly shaped receptacle so that contacts on the terminal come into contact with corresponding contacts positioned near the bottom of the receptacle when the conical rubber element is fully received within the receptacle. Conductive elements disposed within the terminal element serve to electrically connect the contacts on the terminal with the electrical conductors of the cable.

Substantial contact between the terminal element and the receptacle must be maintained because problems, such as arcing, can occur when the terminal element separates from the receptacle. However, typical cable assemblies are often subjected to mechanical and thermal effects, such as those discussed elsewhere herein, that contribute to separation, and/or misalignment, of the terminal and the receptacle.

For example, at least some of the problems experienced in connection with the use of typical cable assemblies in high voltage, high temperature operating environments concern the effects of the associated thermal conditions on the rubber terminal element of the terminal of the cable assembly. More particularly, repeated thermal expansion and contraction of the terminal element often causes the terminal to separate from the receptacle so that a gap is introduced between the terminal and the receptacle.

Thus, when the device is reenergized, the physical separation between the contacts of the terminal and the contacts of the receptacle, in connection with the associated high potential, often causes arcing between the cable assembly and the receptacle, as well as related problems and conditions. Such arcing can damage, or destroy, the cable assembly and/or the device to which the cable assembly is mated.

Not only are known cable assemblies subject to separation from the receptacle under the influence of typical operating conditions, but it is often the case that such operating conditions cause part, or all, of the terminal to become axially misaligned, relative to the receptacle. Because the terminal element typically comprises a resilient material such as rubber, the terminal element offers little resistance to the forces that cause such misalignment. Because the motion of the terminal to the misaligned position is not well constrained, significant deformation occurs to the terminal element. Such deformation compromises the performance of the terminal element, and repeated misalignment cycles may ultimately destroy the terminal element.

In view of the foregoing, and other, problems in the art, it would be useful to provide a cable terminal and clamp system configured to, among other things, facilitate and maintain a cable terminal in a desired position and alignment relative to an associated receptacle, over a range of operating conditions.

BRIEF SUMMARY OF EXAMPLE EMBODIMENTS

Generally, embodiments of the invention concern a cable terminal and clamp system that is configured to accommodate a predetermined amount of axial excursion of a cable terminal, relative to a corresponding receptacle, while maintaining the alignment of the cable terminal relative to the receptacle and/or other structures.

In one example embodiment, a cable clamp assembly is configured to be removably attached to a cable terminal assembly. The cable clamp assembly defines one or more keyways aligned with corresponding keyways of the cable terminal assembly. Keys disposed in each of the keyways ensure that a desired alignment of the cable terminal relative to the receptacle is maintained, notwithstanding changing operational conditions. In this implementation, the keys and/or the keyways comprise a low-friction material or coating so that axial motion of the cable terminal, as occurs under the influence of various operational conditions, is not materially impaired.

In an example embodiment, the cable clamp assembly is configured to cooperate with the cable terminal assembly in a manner so as to confine a spring that functions to bias the cable terminal into the receptacle. More particularly, the spring serves to maintain a load on the cable terminal so that the cable terminal remains in operable contact with the receptacle over a range of operating conditions.

In an example operation, the terminal element of the cable terminal assembly is inserted into the receptacle until the contacts of the terminal element come into contact with corresponding contacts of the receptacle. The keyways of the cable clamp assembly are aligned with the keyways of the cable terminal, wherein the keys are positioned, and the cable clamp assembly is then lowered into position, trapping the spring between the cable terminal assembly and the cable clamp assembly. The cable clamp assembly is then secured to the x-ray, or other, device.

As the cable terminal heats up in response to operation of the device, linear expansion of the terminal element causes compression of the spring by the terminal, so that a force remains applied to the terminal element, thereby causing the terminal element to remain operably seated in the receptacle. When the cable terminal cools, the terminal element linearly contracts. However, the force exerted by the spring ensures that the cable terminal nonetheless remains properly seated in the receptacle.

Further, the keyways defined by the cable clamp assembly and the cable terminal, respectively, cooperate with the keys to ensure that the cable terminal remains substantially axially aligned with the receptacle, notwithstanding the influence of operating conditions, such as extreme heat and thermal cycles, the influence of any external forces exerted upon the cable terminal and/or vibration of the device during operation.

Embodiments of the invention provide for, among other things, establishment and maintenance of an effective and reliable electrical connection between the cable terminal and the receptacle. Additionally, damage to the cable terminal, and the attendant problems that typically arise from axial misalignment with the receptacle, are minimized. These and other advantages and features will become more fully apparent from the following description and appended claims.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF EXAMPLE EMBODIMENTS OF THE INVENTION

Reference will now be made to the drawings to describe various aspects of exemplary embodiments of the invention. It should be understood that the drawings are diagrammatic and schematic representations of such example embodiments and, accordingly, are not limiting of the scope of the present invention, nor are the drawings necessarily drawn to scale.

Generally, example embodiments of the invention concern a cable clamp assembly that is configured to accommodate a predetermined amount of axial excursion of a cable terminal, relative to a corresponding receptacle, while maintaining both the axial alignment of the cable terminal relative to the receptacle and, the position of the cable terminal within the receptacle. Such exemplary embodiments are configured to operate effectively and reliably over a range of operating conditions. Thus, exemplary embodiments of the invention provide for, among other things, establishment and maintenance of an effective and reliable electrical connection between the cable terminal and the receptacle. Additionally, damage to the cable terminal, and the attendant problems, that typically arise from axial misalignment of the cable terminal with the receptacle, are substantially precluded.

While embodiments of the invention may be employed in connection with a variety of systems and devices, embodiments find particular use and functionality in connection with x-ray systems and devices. However, the scope of the invention should not necessarily be construed to be limited to any particular application or operating environment. Finally, combinations of the cable terminal assembly and cable clamp assembly may sometimes be referred to herein as a "cable terminal and clamp system."

I. Aspects of an Exemplary Cable Terminal Assembly

Figure 1:
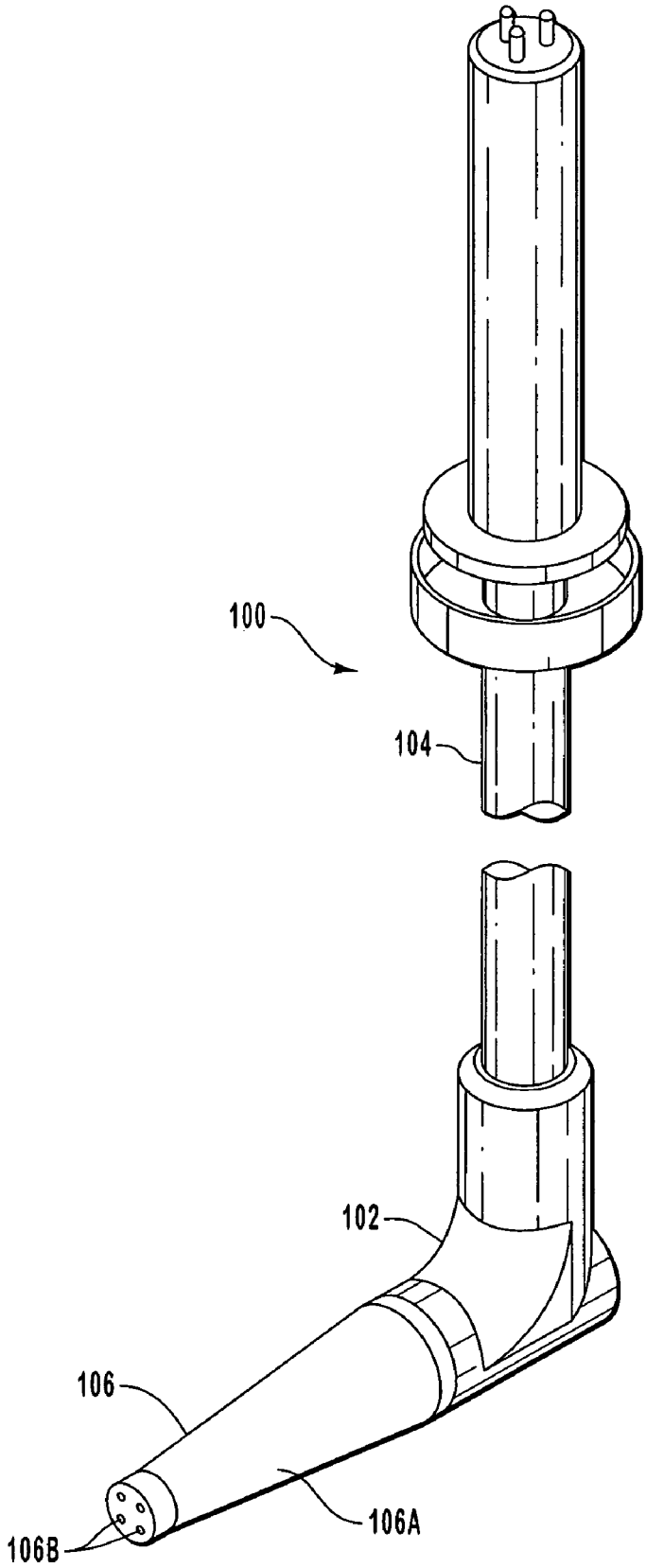
FIG. 1 is a perspective view of an exemplary cable terminal suitable for employment in connection with the cable clamp assembly.
Figures 1A, 1B, 1C:
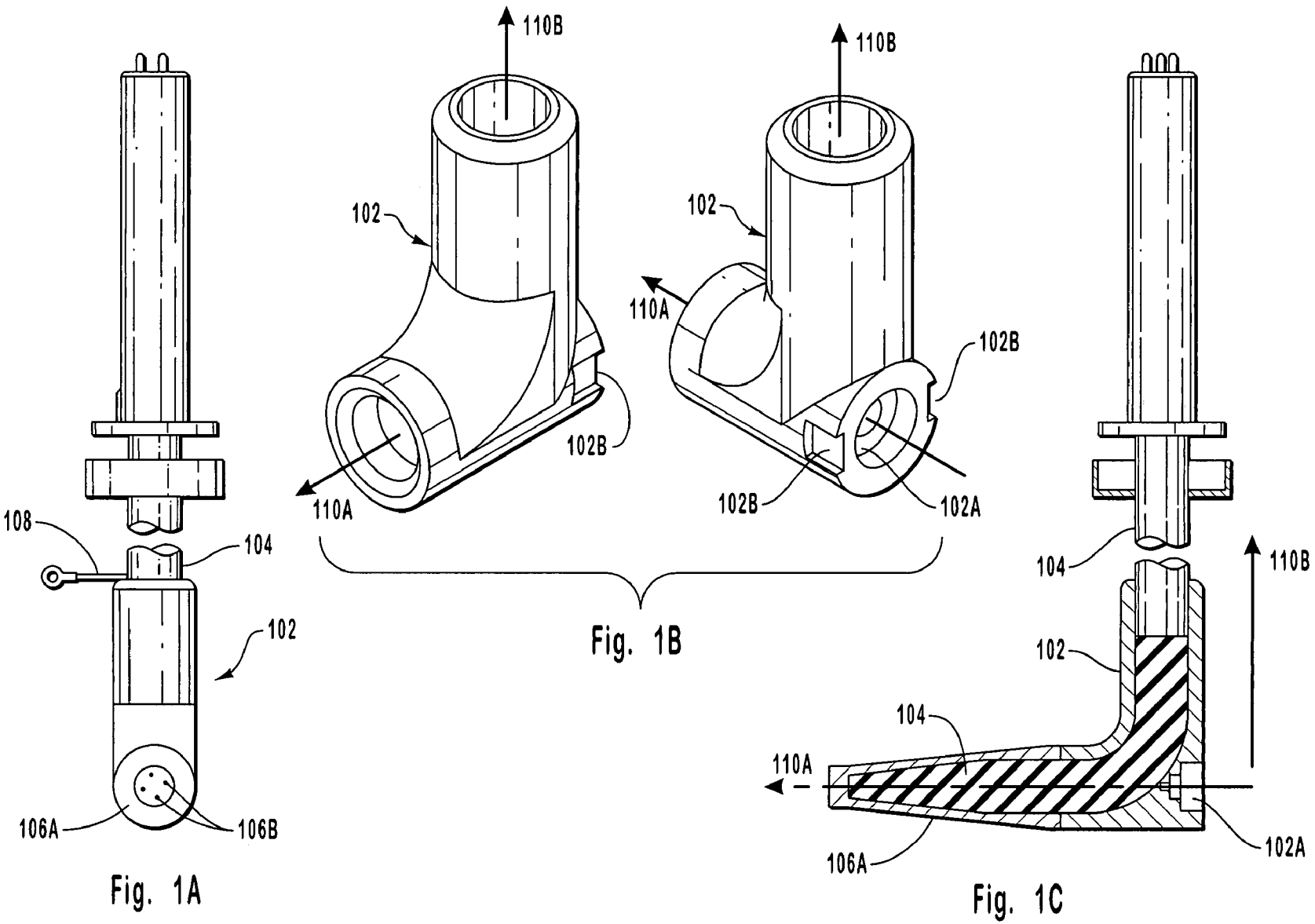
FIG. 1A is a bottom view of the cable terminal illustrating keyways configured and arranged to align with corresponding keyways of an exemplary implementation of the cable clamp assembly.
FIG. 1B is a perspective view providing further details of the location and orientation of the keyways of a cable terminal assembly.
FIG. 1C is a section view indicating further aspects of the construction of an exemplary implementation of a cable terminal assembly.

Directing attention now to FIGS. 1 through 1C, details are provided concerning an exemplary cable terminal assembly, generally designated at 100. The cable terminal assembly 100 generally includes a cable socket 102, a length of cable 104, and a terminal 106, arranged so that the cable 104 passes into the cable socket 102 and connects with the terminal 106. As indicated in FIG. 1A, the cable terminal assembly 100 further includes a shielding and bonding cable 108, exemplarily implemented as a braided cable incorporating a terminal lug.

In one exemplary implementation, the cable 104 is configured for use in applications up to a peak voltage of 200 Kv DC. One suitable high voltage cable, is Okonite 504-22-7410, made by the Okonite Company, located at 102 Hilltop Road Ramsey, N.J. 07446. Of course, cables having other characteristics may alternatively be employed, and the scope of the invention should be not construed to be limited to use in connection with any particular type of cable.

The cable socket 102 exemplarily comprises aluminum or an aluminum alloy, but any other suitable material(s) may alternatively be employed. Finally, the terminal 106 comprises a conically shaped terminal element 106A, substantially comprised of a resilient material such as rubber, nylon, plastic, or thermoplastic, that terminates in a plurality of terminal contacts 106B that electrically communicate with the cable 104.

Directing more particular attention to FIGS, 1B and 1C, the cable socket 102 further defines a recess 102A, which may be round or any other suitable shape, configured and arranged to at least partially receive and confine a resilient element, such as a spring, as discussed below in connection with FIGS. 5 through 8. Generally however, the spring received in recess 102A exerts a force on the cable socket 102 that is transmitted to the terminal element 106A. This force serves to maintain the terminal element 106A in a desired position relative to an associated receptacle (see, e.g., FIG. 8). Exemplary embodiments of systems and devices that implement control of the positioning of a terminal element in this way are disclosed and claimed in U.S. Pat. No. 6,556,654 issued to Hansen et al., and incorporated herein in its entirety by this reference.

Note that, as used herein with reference to the exemplary embodiments of the cable terminal assembly, clamp assembly, and cable terminal and clamp system disclosed herein, motion along, or parallel to, an axis, such as the various axes disclosed herein, includes motion in either direction along such an axis.

Figure 3B:
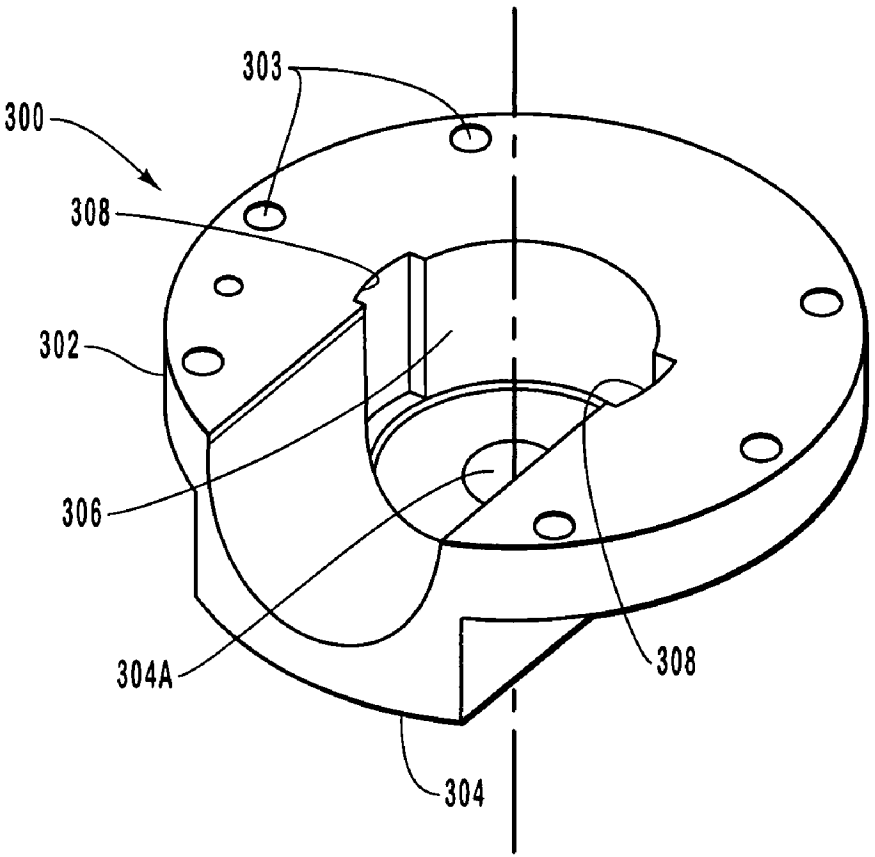
FIG. 3B is a bottom perspective view of the exemplary cable clamp depicted in FIG. 3A.
Figure 3A:
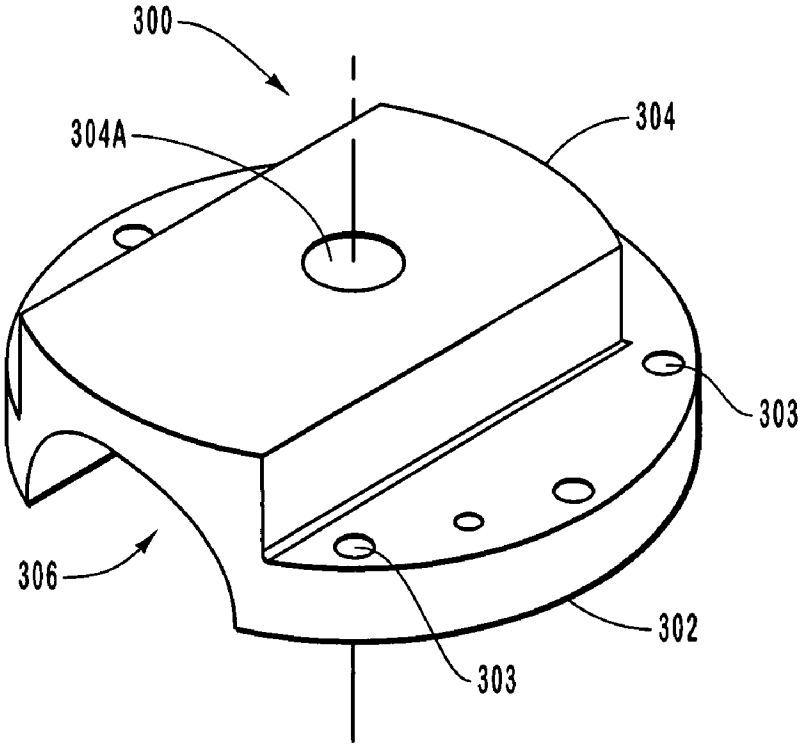
FIG. 3A is a top perspective view illustrating various aspects of an exemplary cable clamp.
Figure 3D:
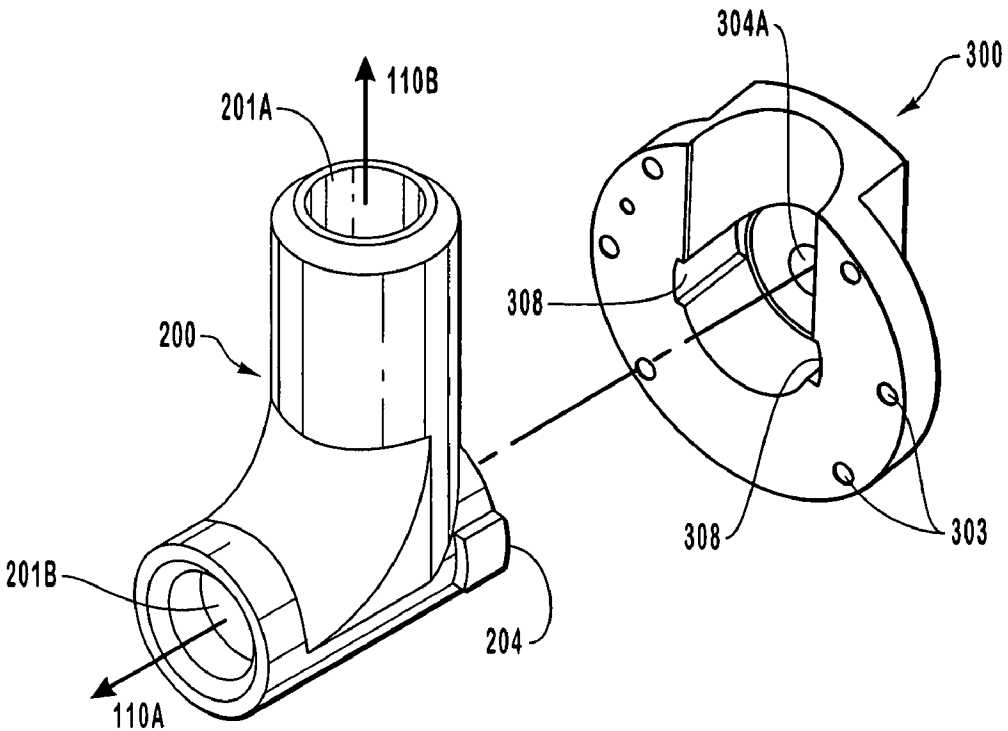
FIG. 3D is a perspective view illustrating how an exemplary cable clamp and cable terminal assembly fit together.
Figure 3C:
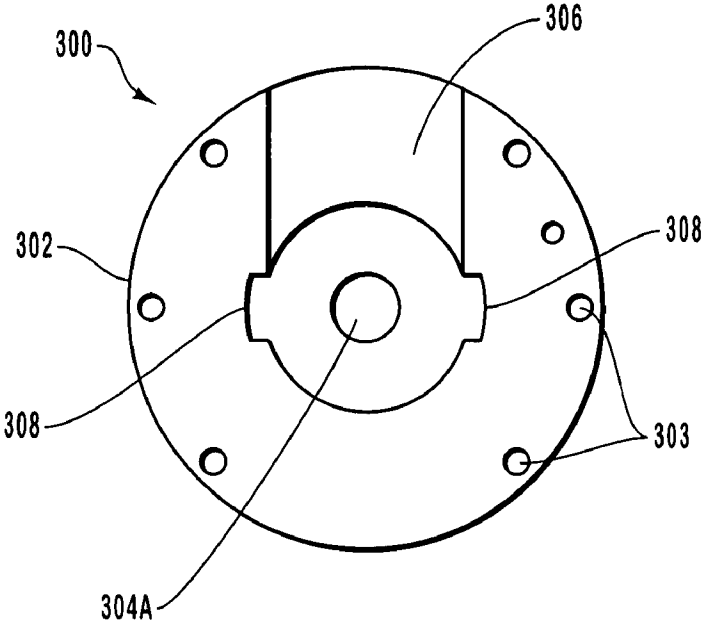
FIG. 3C is a bottom view of the exemplary clamp illustrated in FIGS. 3A and 3B, showing a pair of keyways configured and arranged to align with corresponding structure of a cable terminal assembly.
Figure 5:
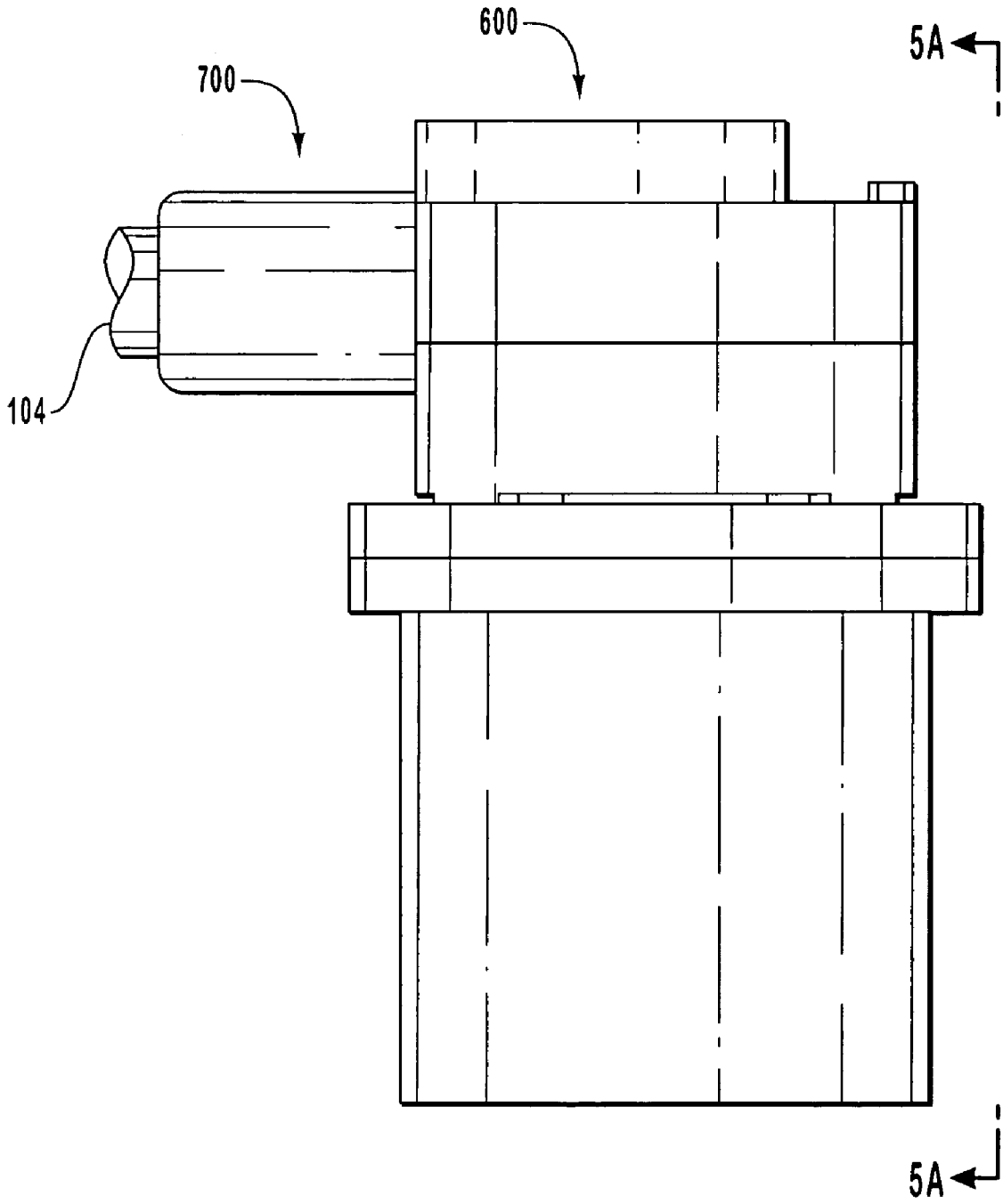
FIG. 5 is a top cutaway view of an exemplary cable terminal assembly, indicating the configuration and arrangement of various structures employed in the alignment of the cable terminal.

As further indicated in FIG. 1B, the exemplary implementation of the cable socket 102 also defines a pair of keyways 102B. Generally, the keyways 102B are substantially parallel to axis 110A and are further configured and arranged to align with corresponding keyways defined by a cable clamp (see, e.g., FIGS. 3A through 3C) so as to facilitate the constraint of various motions of the cable terminal assembly 100 relative to the clamp, as discussed in further detail below in connection with FIGS. 3A through 3C, for example. While the illustrated implementation includes two keyways, more or fewer keyways may be employed, consistent with the requirements of a particular application. Likewise, the geometry and arrangement of the keyways may be varied as necessary. Generally, the geometry of the keys substantially reflects the geometry of the associated keyways. Aspects of one exemplary arrangement of keys and keyways are illustrated in FIG. 5, discussed below.

The keyways 102B, as well as the keyways of the cable clamp, and/or the associated keys (not shown), exemplarily comprise, are coated with, or otherwise include, a relatively low friction material so that motion of the cable terminal assembly 100 along axis 110A (see, e.g., FIGS. 1B and 1C) is substantially unimpaired. Examples of such low friction materials include, but are not limited to, nylon, acetal homopolymers, and polytetrafluoroethylene ("PTFE"). Any other suitable material(s) may alternatively be employed however.

Figure 2B:
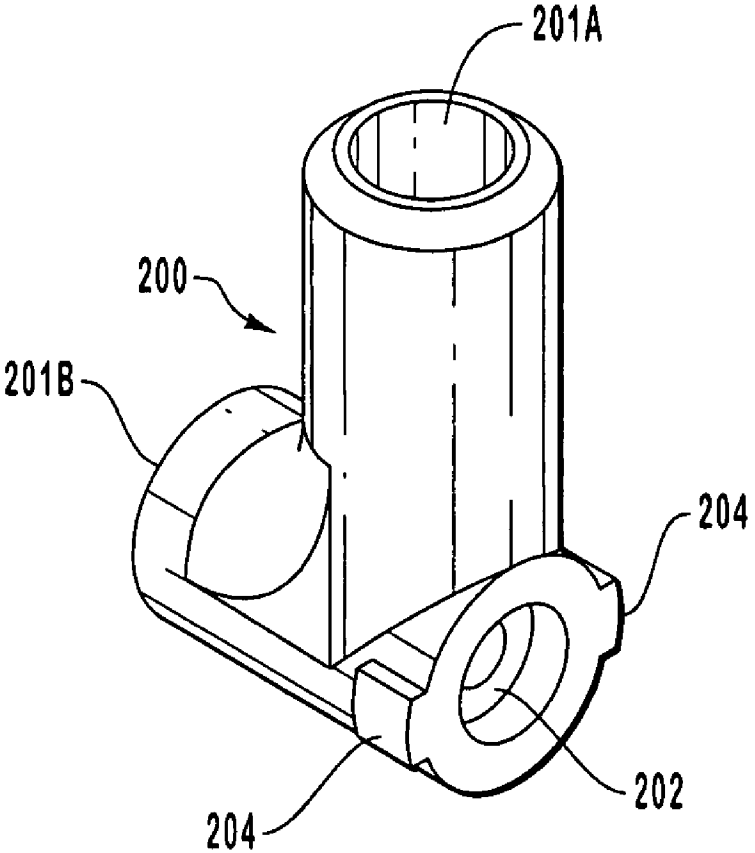
FIG. 2B illustrates another perspective of the exemplary cable terminal assembly depicted in FIG. 2A.
Figure 2A:
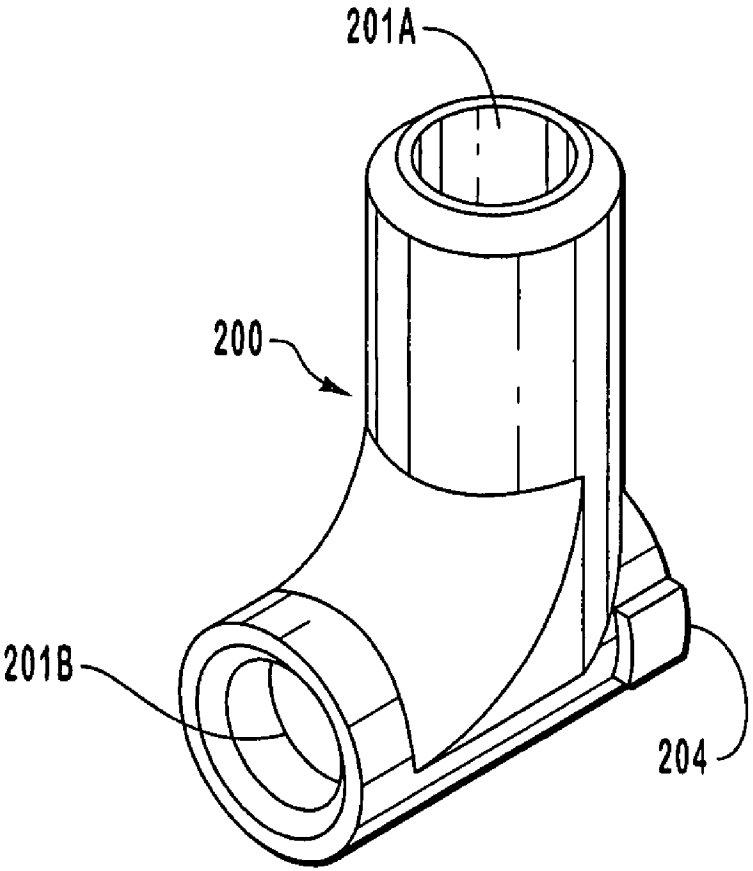
FIG. 2A is a perspective view of an alternative implementation of the cable terminal assembly that includes a pair of integral keys configured and arranged to be received by corresponding structure of an exemplary cable clamp assembly.

With attention now to FIGS. 2A and 2B, details are provided concerning an alternative implementation of the cable socket, denoted generally at 200. Cable socket 200 is similar in many regards to cable socket 102. For example, cable socket 200 defines a cable port 201A configured to receive a cable, as well as a terminal port 201B configured to be attached to a terminal with which the cable communicates.

The cable port 201A of the cable socket 200 generally defines an axis 110A (see FIGS. 1B and 1C), while the terminal port 201B defines an axis 110B (see FIGS. 1B and 1C). In some implementations of the cable socket, the axes 110A and 110B are substantially perpendicular to each other, while in other embodiments of the invention, the cable socket is configured so that axes 110A and 110B are arranged in an alternative non-parallel arrangement with respect to each other. Accordingly, the scope of the invention should not be construed to be limited to the exemplary cable socket implementations disclosed herein.

In addition, the cable socket 200 defines a recess 202 configured and arranged to receive, and partially confine, a spring. However, cable socket 200 does not define keyways. Rather, cable socket 200 includes a pair of integral keys 204 configured and arranged to be received in corresponding keyways defined by the cable clamp assembly, discussed below.

Aspects such as the number, geometry, and placement of the integral keys 204 may be varied as required to suit a particular application. Moreover, while the exemplary embodiment of the cable socket 200 illustrated in FIGS. 2A and 2B includes integral keys, the scope of the invention is not so limited. Rather, other exemplary embodiments include, as discussed above in connection with FIGS. 1 through 1C, one or more discrete keys that can be removably positioned within associated keyways defined by a cable socket and/or cable clamp assembly.

II. Aspects of Exemplary Cable Clamp Implementations

Directing attention now to FIGS. 3A through 3D, details are provided concerning an exemplary implementation of a cable clamp, denoted generally at 300. The cable clamp 300 exemplarily comprises brass, but any other suitable material may alternatively be employed.

In the illustrated implementation, the cable clamp 300 includes a substantially circular base 302 that defines a number of holes 303, which may be through holes or tapped, configured to receive bolts or other fasteners so that the cable clamp 300 can be removably attached to the structure of the device in connection with which the cable clamp 300 and cable terminal assembly are to be employed. Further details concerning such attachment of the cable clamp 300 are provided below in connection with the discussion of, for example, FIG. 8.

Disposed atop the base 302 is a housing 304 that cooperates with the base to define a cavity 306 whose geometry generally reflects that of the cable socket (see, e.g, FIGS. 1 through 1C) so that the cable socket can be received within the cable clamp 300, as indicated for example, in FIGS. 5 through 8, discussed below. The cavity 306 also partially receives a spring, as discussed above and illustrated in FIGS. 5 through 8. In addition, the housing 304 defines an opening 304A that communicates with cavity 306 and that is configured to receive elements of an adjustment mechanism (see, e.g., FIGS. 5 through 8).

Finally, the illustrated embodiment of the cable clamp 300 defines a pair of keyways 308 generally configured to be aligned with corresponding keyways of a cable terminal assembly, such as cable terminal assembly 100, when the cable terminal assembly is received in the cavity 306. This arrangement has various useful implications.

For example, when the keyways are aligned thus, and arranged substantially parallel to the imaginary axis 110A (see, e.g., FIGS. 1B and 1C), and when corresponding keys positioned in such keyways, motion of the cable terminal assembly 100 and, particularly, the terminal 106, in a direction along axis 110B (see, e.g., FIGS. 1B and 1C) is substantially precluded. In this way, the axial alignment of the terminal 106 relative to the receptacle (not shown) is maintained. That is, the terminal 106 of the cable terminal assembly 100 remains in a substantially coaxial arrangement with the receptacle, notwithstanding changing thermal, and other operational, conditions, or the application of external forces. Additionally, the keys and keyways also serve to maintain the position of the cable terminal assembly 100, including the cable socket 102, relative to the cable clamp 300.

Thus, damage to the terminal 106 and/or cable terminal assembly 100 that typically results when motion of the cable terminal assembly 100 is not constrained along axis 100B is substantially foreclosed. Further, constraint of such motion also helps to ensure that the terminal 106 remains operably positioned within the receptacle, so that arcing and other problems are prevented.

Moreover, while the positioning and alignment of the keyways 308 aids in the constraint of motion of the cable terminal assembly 100, as described above, the keyways 308 are arranged so as not to impair other aspects of the operation of the cable clamp 300 and associated cable terminal assembly 100. In particular, because the keyways 308 are arranged to be substantially parallel to the axis 110A of the cable terminal assembly 100, the cable terminal assembly, and the terminal 106 in particular, are free to move back and forth along axis 110A in response to changing thermal conditions and the influence of the spring (see, e.g., FIGS. 5 and 5A) confined between the cable terminal assembly 100 and cable clamp 300.

Figure 4B:
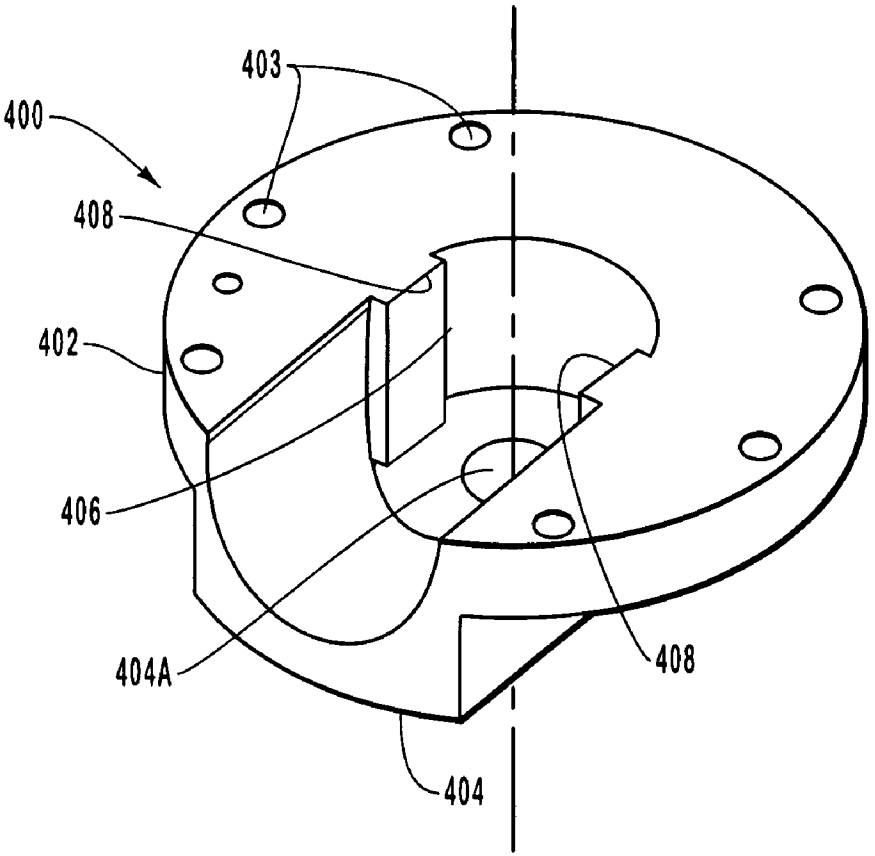
FIG. 4B is a bottom perspective view of the exemplary cable clamp depicted in FIG. 4A.
Figure 4A:
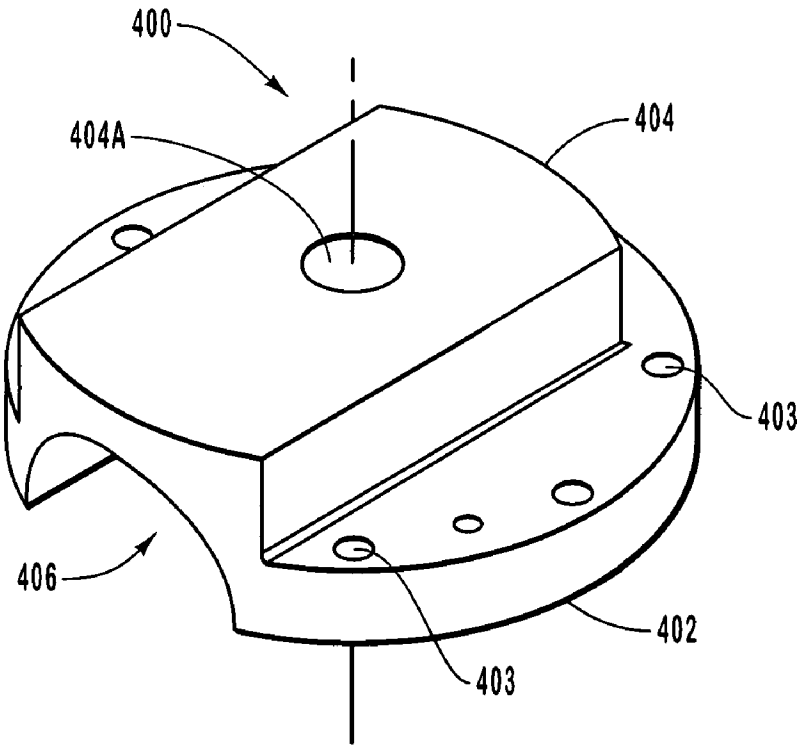
FIG. 4A is a top perspective view illustrating various aspects of an exemplary cable clamp that includes a pair of integral keys.
Figure 4D:
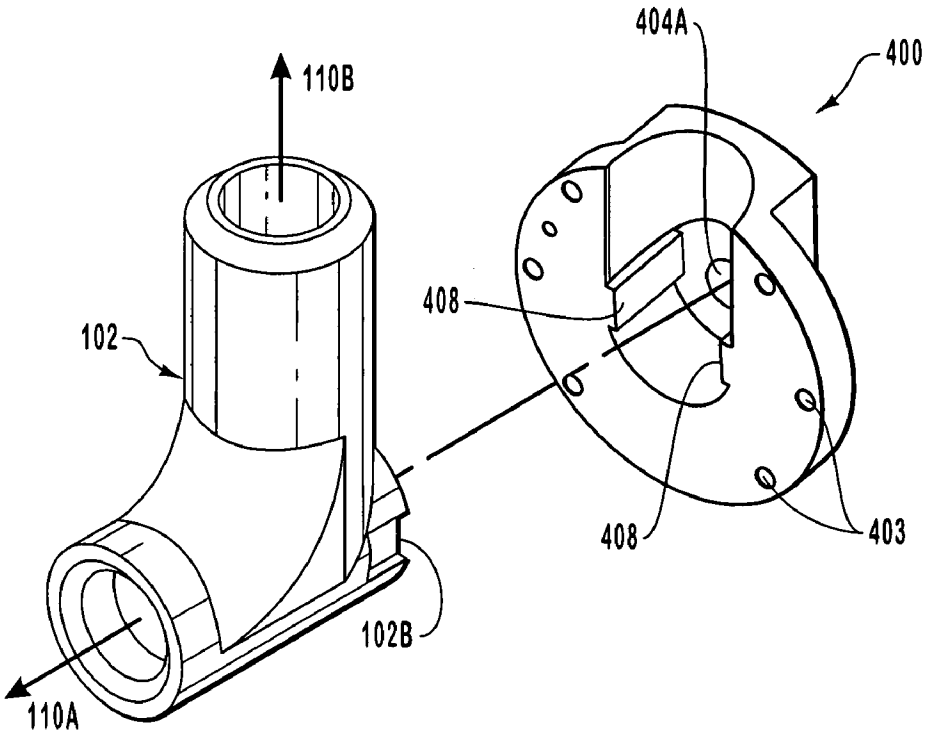
FIG. 4D is a perspective view illustrating how an exemplary cable clamp and cable terminal assembly fit together.
Figure 4C:
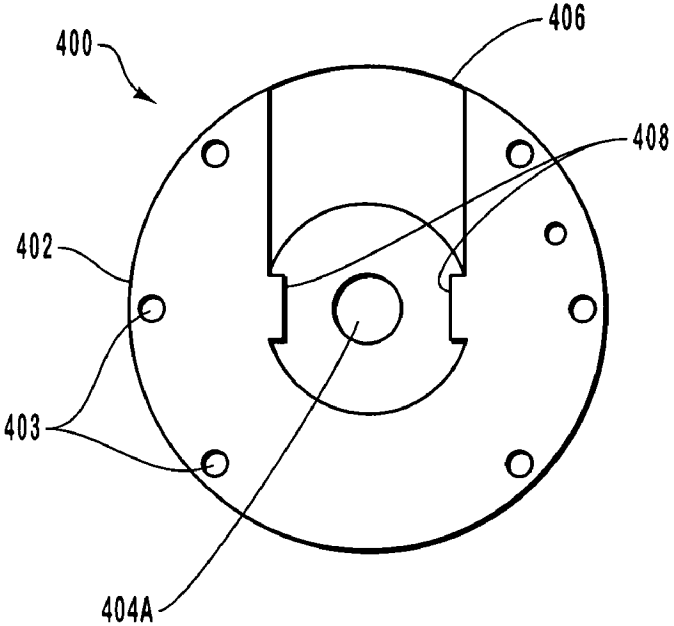
FIG. 4C is a bottom view of the exemplary clamp illustrated in FIGS. 4A and 4B, showing a pair of integral keys configured and arranged to align with corresponding structure of a cable terminal assembly.

With attention now to FIGS. 4A through 4C, details are provided concerning an alternative embodiment of the clamp, generally denoted at 400. Similar to the exemplary cable clamp implementation illustrated in FIGS. 3A through 3C, the cable clamp 400 includes a substantially circular base 402 that defines a number of holes 403, which may be through holes or tapped, configured to receive bolts or other fasteners so that the cable clamp 400 can be removably attached to the structure of the device in connection with which the cable clamp 400 and cable terminal assembly are to be employed.

Disposed atop the base 402 is a housing 404 that cooperates with the base to define a cavity 406 whose geometry generally reflects that of the cable socket (see, e.g, FIGS. 1 through 1C) so that the cable socket can be received within the cable clamp 400, as indicated for example, in FIGS. 5 through 8, discussed below. The cavity 406 also partially receives a spring, as discussed above and illustrated in FIGS. 5 through 8.

In addition, the housing 404 defines an opening 404A that communicates with cavity 406 and that is configured to receive an indicator, such as a post (see, e.g., FIGS. 5 through 8), that generally provides visual indication of the position, along axis 110, of the cable terminal assembly relative to the cable clamp assembly. Finally, the illustrated embodiment of the cable clamp 400 defines a pair of integral keys 408 generally configured to be aligned with, and received by, corresponding keyways of a cable terminal assembly, such as cable terminal assembly 100, when the cable socket of the cable terminal assembly is received in the cavity 406.

As suggested by the foregoing discussion of the different implementations of cable sockets and cable clamps, various combinations of different configurations of the cable clamp and cable socket may be employed. By way of example, a cable socket that defines keyways may be employed, along with an appropriate set of keys, in connection with a cable clamp that defines corresponding keyways. As another example, a cable socket that defines keyways may be employed in connection with a cable clamp that includes integral keys. In yet another implementation, a cable clamp that defines keyways may be employed in connection with a cable socket that includes integral keys.

As disclosed herein, a variety of means may be employed to maintain the axial position of the cable terminal assembly relative to an associated receptacle and/or cable clamp. Thus, the keys and keyways disclosed herein, as well as the post/hole configurations comprise exemplary structural implementations of a means for maintaining alignment. It should be understood however, that such structural implementations should not be construed as limiting the scope of the present invention in any way. Rather, any other structure or combination of structures effective in implementing the functionality disclosed herein may likewise be employed.

III. Aspects of Exemplary Cable Terminal and Clamp System Installations

Figure 5A:
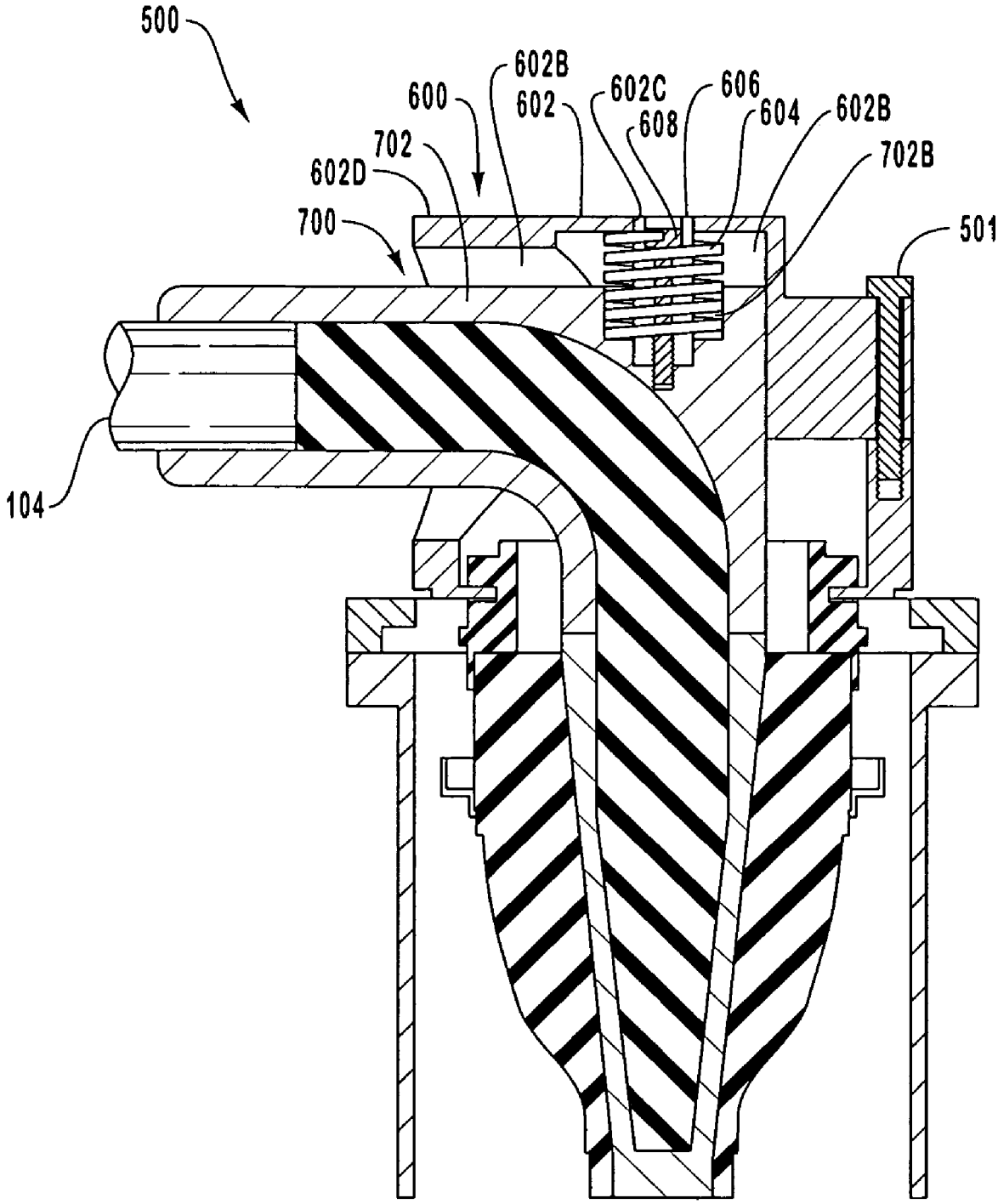
FIG. 5A is a section view taken along the line indicated in FIG. 5.

With attention now to FIGS. 5 and 5A, details are provided concerning an exemplary cable terminal and clamp system, denoted generally at 500. It should be noted that the implementation illustrated in FIG. 5 employs a cable clamp such as is exemplified in FIGS. 3A through 3C. However, the scope of the invention should not be construed to be so limited.

Generally, the cable terminal and clamp system 500 includes a cable clamp assembly 600 configured to removably receive at least a portion of a cable terminal assembly 700, in the manner disclosed elsewhere herein. As best illustrated in FIG. 5A, the cable clamp assembly 600 cooperates with the structure of the device in connection with which the cable terminal and clamp system 500 is employed to secure the cable terminal assembly 700. In particular, the cable clamp assembly 600 is removably attached to the device with one or more fasteners 501, such as bolts or cap screws.

With more particular reference now to the cable clamp assembly 600, a cable clamp 602 is provided that defines a pair of opposing keyways 602A arranged substantially parallel to the axis 110A (see, e.g., FIG. 1C). Similarly, the cable terminal assembly 700 includes a cable socket 702 that defines a set of keyways 702A substantially aligned with the keyways 602A. Each of the keyways 702A cooperates with an opposing keyway 602A to define a space wherein a key 502 is received. When thus arranged, the keyways 602A and 702A, in cooperation with key(s) 502, effectively allow motion of the cable socket 702, relative to the clamp 602, along axis 110A (see FIG. 1C), but substantially prevent motion of the cable terminal assembly, relative to the cable clamp assembly, along axis 110B.

At the same time, a resilient element 604 is confined in the space collectively defined by a recess 702B of the cable socket 702 and a cavity 602B of the cable clamp 602. The lower end of a post 606, about which the resilient element 604 is disposed, resides in the recess 702B and is fixed to the cable socket 702 by a fastener 608, exemplarily implemented as a bolt or cap screw. The upper end of the post 606 is slidingly received within an opening 602C defined in the cable clamp 602 so that as the cable socket 702 moves in response to thermal expansion of the terminal (not shown), the position of the upper end of the post 606, relative to the upper surface 602D of the cable clamp 602, serves as an indicator of the extent of thermal expansion of the terminal. In an alternative embodiment, illustrated in FIG. 6, post 606 is integral with the cable socket 702. Further details concerning operational aspects of exemplary embodiments of the cable terminal and clamp system 500 are provided below.

With respect to the resilient element 604, it should be noted that a helical spring such as is illustrated is but one exemplary implementation of the resilient element 604. Various other resilient elements may be employed in place of such a helical spring. For example, in other implementations of the invention, one or more Belleville spring washers are employed instead. Accordingly, the scope of the invention should not be construed to be limited solely to the resilient elements disclosed herein. Further, aspects such as, but not limited to, the spring constant, and the magnitude of any preload placed on the resilient element, may be varied as necessary to suit the requirements of a particular application.

Figure 6:
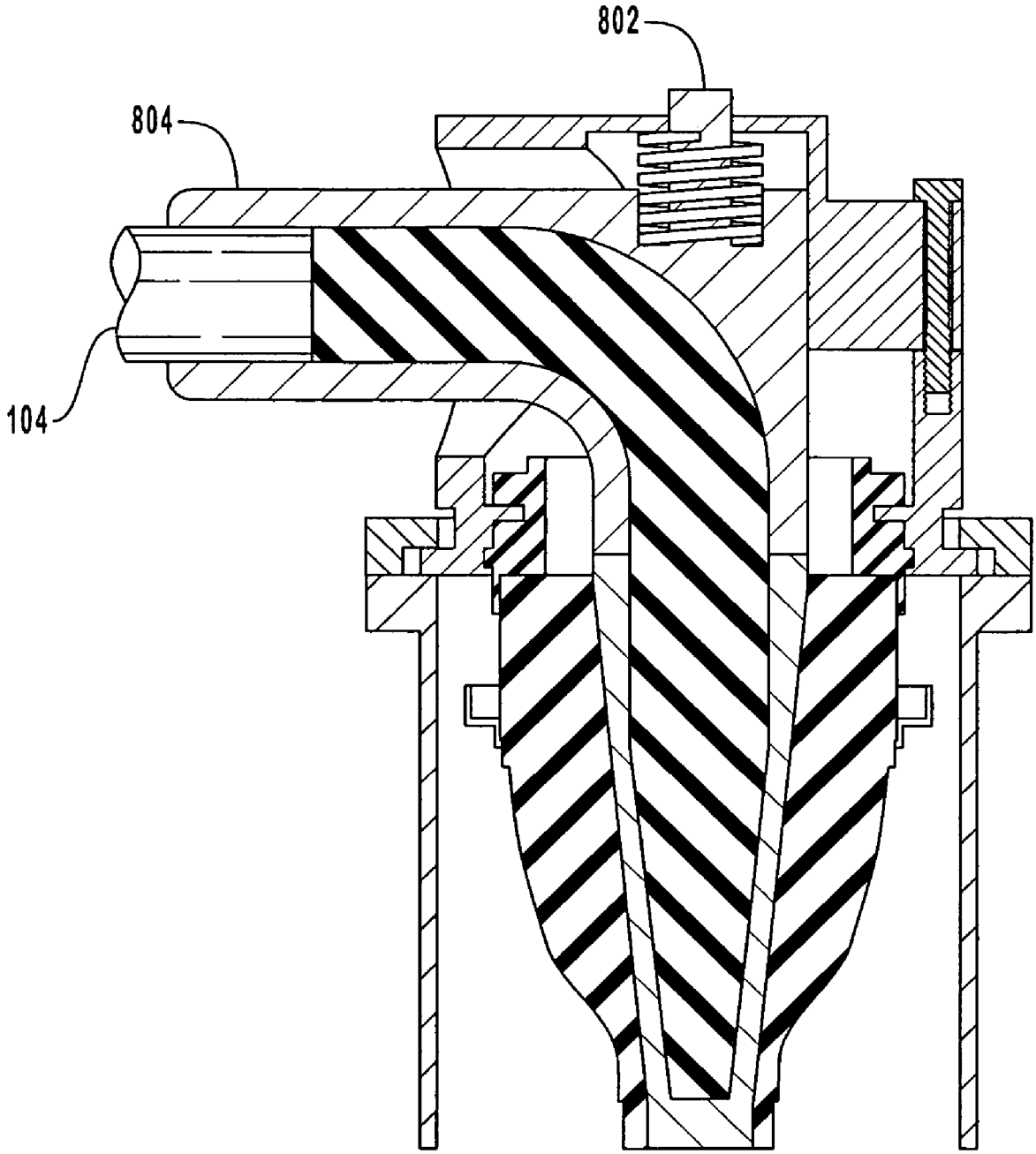
FIG. 6 is a section view of an alternative implementation of a cable terminal assembly and cable clamp assembly, indicating various details concerning the arrangement and interaction of such assemblies.

Directing attention now to FIG. 6, details are provided concerning an alternative embodiment of a cable terminal and clamp system. The embodiment illustrated in FIG. 6 is substantially similar to that illustrated in FIG. 5. However, as indicated in FIG. 6, a post 802 is provided that is integral with the cable socket 804. The operation of the embodiment illustrated in FIG. 6 is similar to the operation of the embodiment illustrated in FIG. 5.

Figure 7:
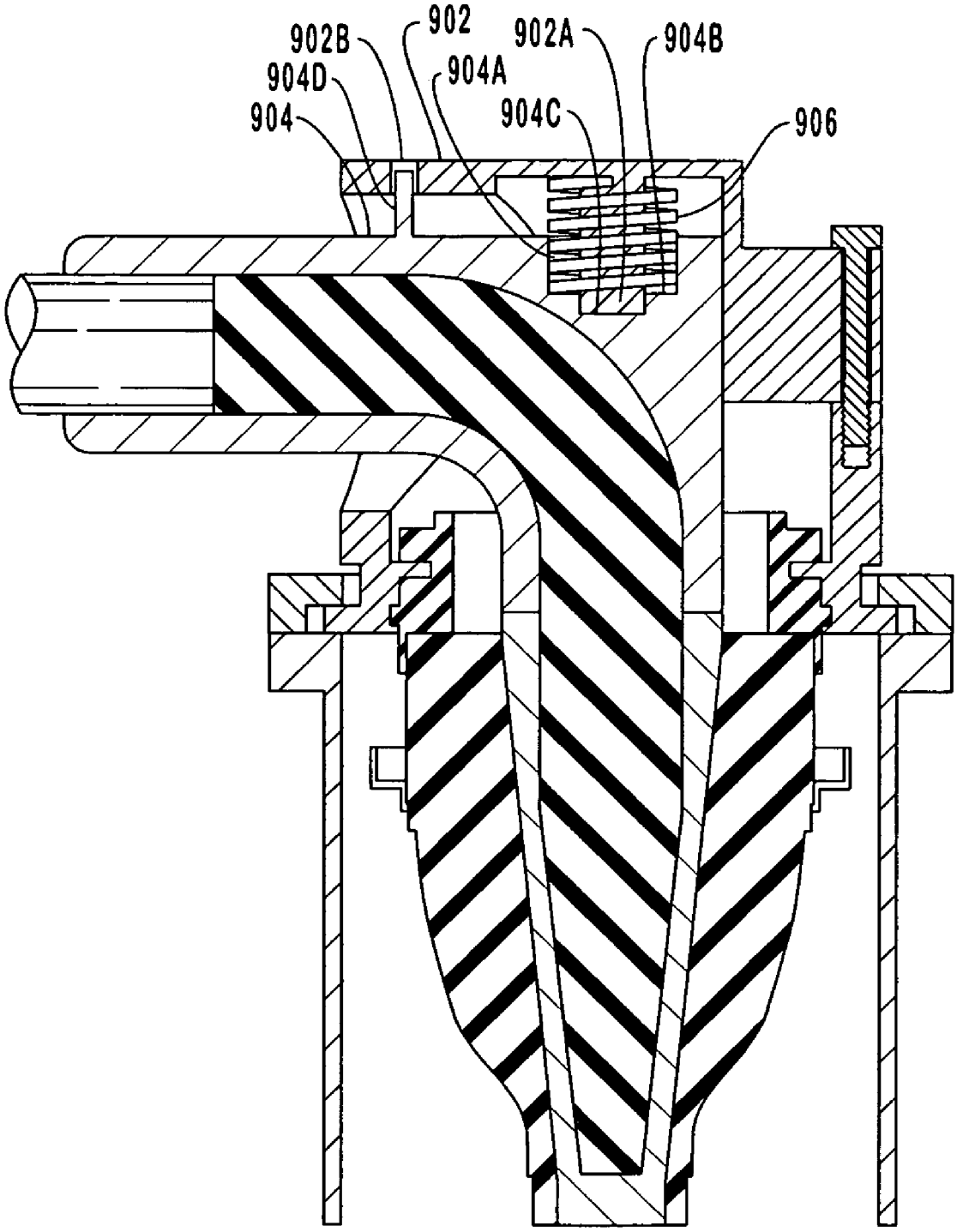
FIG. 7 is a section view of yet another implementation of a cable terminal assembly and cable clamp assembly, indicating various details concerning the arrangement and interaction of such assemblies.

With attention now to FIG. 7, aspects of another implementation of the cable terminal and clamp system are illustrated. As the implementation illustrated in FIG. 7 is similar to other implementations disclosed herein, the discussion of FIG. 7 will focus only on selected aspects of the illustrated embodiment.

Similar to other embodiments of the cable terminal and clamp system disclosed herein, the illustrated embodiment of the cable terminal and clamp system 900 includes a cable clamp 902 within which is at least partially received a cable socket 904. The cable clamp 902 is secured to the structure of the x-ray, or other, device by way of fastener(s) 906.

The cable socket 904 defines a recess 904A having a shoulder 904B upon which a spring 906 rests. A guide portion 904C of the recess 904A is configured and arranged to slidingly receive a corresponding post 902A of the cable clamp 902. The post 902A and/or the guide portion 904C comprise, include, or otherwise incorporate, low-friction materials such as those disclosed elsewhere herein so that motion of the cable socket 904 relative to the cable clamp 902 is not materially impaired. Further, an indicator 904D is provided that is slidingly received in a recess 902B defined by the clamp 902 so as to indicate the position of the cable terminal assembly relative to the cable clamp assembly.

It should be noted that the illustrated embodiment is exemplary only and aspects of the recess 904A, shoulder 904B, guide portion 904C and post 902C including, but not limited to, their respective sizes, geometries, and positioning may be varied as necessary to suit the requirements of a particular application.

With general reference to the operation of the embodiment illustrated in FIG. 7, linear expansion of the terminal (see, e.g., FIG. 1C) that is attached to the cable socket 904 causes the cable socket 904 to move upward toward the cable clamp 902, further compressing the spring 906. As the terminal cools, the spring 906 urges the cable socket 904 away from the cable clamp 902, in substantially the reverse fashion. In this way, the guide portion 904C enables accommodation of the linear expansion and contraction of the terminal, while the spring 906 ensures that an axial force is continuously applied to the terminal, so that the terminal is maintained in operable contact with the receptacle.

IV. Operational Aspects of a Cable Terminal and Clamp System

With attention now to the implementation illustrated, for example, in FIGS. 5, 5A and 6, details are provided concerning various operational aspects of the cable terminal and clamp system. Initially, the terminal (see, e.g., FIG. 1C) is inserted into a corresponding receptacle. The cable clamp 602, is then positioned on the cable socket 702 of the cable terminal assembly 700 and secured in position with one or more fasteners 501. Exemplarily, the attachment of the cable clamp 602 in this way imparts an initial load on the resilient element 604 so that the resilient element 604 is partially compressed at ambient, or room, temperature. In other implementations however, no preload is imposed on the resilient element 604.

More particularly, positioning of the cable clamp 602 on the cable socket 702 involves alignment of the opposing keyways 602A of cable clamp 602 with the corresponding keyways 702A of the cable socket 702. In this exemplary implementation, the keys 502 are inserted into the spaces cooperatively defined by the sets of keyways 602A and 702A and then the cable clamp 602 is oriented so that the keys 502 are partially positioned within the corresponding keyways 602A. The cable clamp 602 is then moved down into its final position and secured.

As the cable terminal assembly 700 heats up, the terminal expands in a substantially linear fashion. This linear expansion causes the cable socket 702 to move closer to the cable clamp 602 along axis 110A, thereby compressing, or further compressing, the resilient element 604. In response, the resilient element 604 exerts a force on the cable socket 702, thereby maintaining the terminal in operational contact with the receptacle. When the cable terminal assembly 700 cools, the resilient element 604 continues to bias the cable socket 702 and, accordingly, the terminal, toward the receptacle, along axis 110A. Thus, the cable terminal and clamp system is able to readily and consistently accommodate the thermal expansion and contraction of the terminal in such a way that the terminal remains properly positioned within the receptacle at all times, notwithstanding changing thermal conditions.

Additionally, the keys 502 and keyways 602A and 702A cooperate to ensure that the motion of the cable socket 702 relative to the cable clamp 602 is substantially confined to motion along the axis 110A. Because the keys 502 and/or keyways 602A and 702A incorporate low friction materials, the motion of the cable socket 702 relative to the cable clamp 602 along axis 110A is not materially impaired. Moreover, prevention of the motion of the cable socket 702 along axis 110B substantially prevents damage and/or deformation to the terminal, as well as to the post 606, that might otherwise occur.

Finally, because the post 606, attached to the cable socket 702, moves in unison with the cable socket 702, the position of the post 606 serves as an indication of the relative position of the cable socket 702 with respect to the cable clamp 602. In particular, as the cable socket 702 moves closer to the cable clamp 602 due to thermal expansion of the terminal, the post 606 moves upward in the recess 602C, from the room temperature position illustrated in FIG. 5A. In this way, an operator can readily ascertain the extent to which the cable socket 702 has moved, as a result of thermal expansion or contraction of the terminal, relative to the cable clamp 602.

V. Aspects of an Exemplary Operating Environment

As noted elsewhere herein, embodiments of the invention are suitable for use in a variety of operating environments. Such embodiments are particularly well-suited for use in high voltage applications such as x-ray devices and systems.

Figure 8:
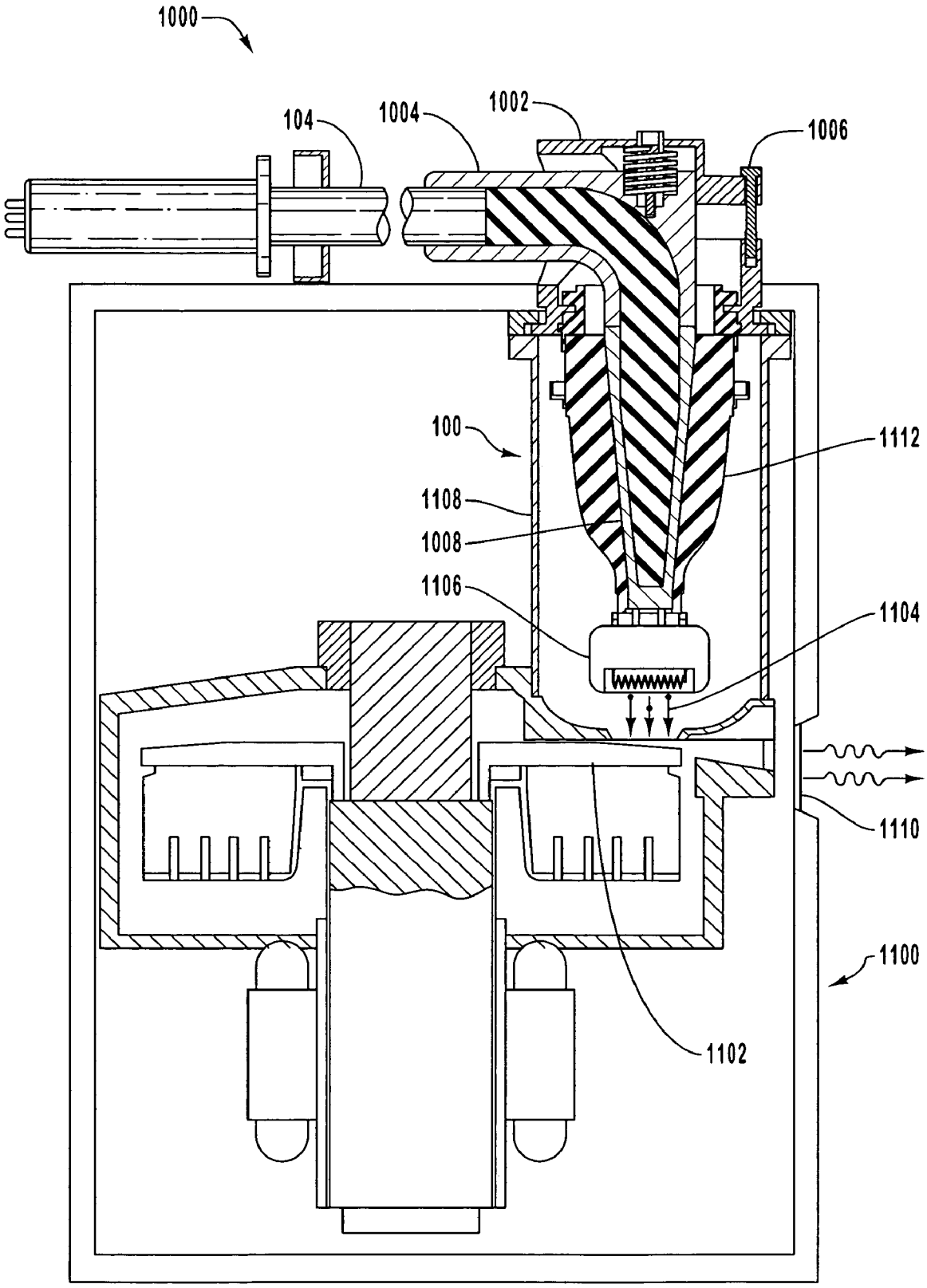
FIG. 8 is a section view illustrating an exemplary operating environment for the cable terminal assembly and the cable clamp assembly.

Directing attention now to FIG. 8, an exemplary implementation of a cable terminal and clamp system 1000 having a clamp assembly 1002 and a cable terminal assembly 1004, as implemented in connection with an x-ray device 1100, is illustrated. In this exemplary implementation, the x-ray device 1100 includes a rotating anode 1102 that is generally positioned to receive electrons 1104 emitted by a cathode 1106 that resides within an evacuated enclosure 1108. As the electrons 1104 emitted by the cathode 1106 strike the target surface of the anode 1102, x-rays are emitted through window 1110.

As further indicated in FIG. 8, the cable terminal and clamp system 1000 is secured to the structure of the x-ray device 1100 by way of one or more fasteners 1006. When thus arranged, the terminal 1008 is positioned within the receptacle 1112 so that the contacts (not shown) of the terminal 1008 are in operational contact with the corresponding contacts (not shown) of the cathode 1106. As disclosed elsewhere herein, the cable terminal and clamp system 1000 ensures that the terminal 1008 remains properly positioned within the receptacle at all times, and also prevents deformation of the terminal 1008 that might otherwise result from various thermal effects or external forces.

The disclosed embodiments are to be considered in all respects only as exemplary and not restrictive. The scope of the invention is, therefore, indicated by the appended claims rather than by the foregoing disclosure. All changes which come within the meaning and range of equivalency of the claims are to be embraced within their scope.

What is claimed is:

1. A cable terminal and clamp system suitable for use in connection with a high-voltage x-ray generating device, and comprising:

a cable terminal assembly including a cable socket having a cable port and a terminal port, each of which defines a corresponding axis;

a cable clamp assembly including a cable clamp configured to receive at least a portion of the cable socket, and the cable clamp assembly and cable socket being configured and arranged so that motion of the cable socket relative to the cable clamp along a first axis is substantially unimpaired, but motion of the cable socket relative to the cable clamp along a second axis is substantially precluded; and a key configured to be at least partially received within a keyway that is oriented substantially along the axis defined by the terminal port of the cable socket, the keyway being defined by at least one of: the cable socket; and, the cable clamp.

2. The cable terminal and clamp system as recited in claim 1, wherein the respective axes defined by the cable port and terminal port are non-parallel with respect to each other.

3. The cable terminal and clamp system as recited in claim 1, wherein the first axis is non-parallel with respect to the second axis.

4. The cable terminal and clamp system as recited in claim 1, wherein the first axis comprises the axis defined by the terminal port of the cable socket.

5. The cable terminal and clamp system as recited in claim 1, wherein the second axis comprises the axis defined by the cable port of the cable socket.

6. The cable terminal and clamp system as recited in claim 1, further comprising:

a terminal attached at least indirectly to the terminal port of the cable socket; and a length of cable at least partially received in the cable port of the cable socket, the length of cable being in electrical communication with the terminal.

7. The cable terminal and clamp system as recited in claim 1, further comprising an indicator that provides visual indication of the position of the cable socket relative to the cable clamp.

8. The cable terminal and clamp system as recited in claim 1, further comprising at least one resilient element interposed between the cable socket and the cable clamp, the at least one resilient element being configured and arranged to bias the cable socket along the first axis, when the cable clamp is attached to the high voltage x-ray generating device.

9. A cable terminal and clamp system suitable for use in connection with a high-voltage x-ray generating device, and comprising:

a cable terminal assembly including a cable socket having a cable port and a terminal port, each of which defines a corresponding axis, the respective axes being disposed in a non-parallel arrangement relative to each other;

a cable clamp assembly including a cable clamp configured to receive at least a portion of the cable socket, and the cable socket and cable clamp assembly being configured and arranged so as to allow relative motion between the cable clamp and cable socket; and a key configured to be at least partially received within a keyway that is oriented substantially along the axis defined by the terminal port of the cable socket, the keyway being defined by at least one of: the cable socket; and, the cable clamp.

10. The cable terminal and clamp system as recited in claim 9, wherein the keyway is defined by the cable clamp.

11. The cable terminal and clamp system as recited in claim 9, wherein the keyway is defined by the cable socket.

12. The cable terminal and clamp system as recited in claim 9, wherein the keyway is cooperatively defined by the cable socket and the cable clamp.

13. The cable terminal and clamp system as recited in claim 9, wherein the key is integral with one of: the cable socket; and, the cable clamp.

14. The cable terminal and clamp system as recited in claim 9, wherein the key comprises an element discrete from the cable socket and the cable clamp.

15. The cable terminal and clamp system as recited in claim 9, further comprising a second key, the second key being configured to be at least partially received within a second keyway that is oriented substantially along the axis defined by the terminal port of the cable socket, the second keyway being defined by at least one of: the cable socket; and, the cable clamp.

16. The cable terminal and clamp system as recited in claim 9, further comprising:

a terminal attached at least indirectly to the terminal port of the cable socket; and a length of cable at least partially received in the cable port of the cable socket, the length of cable being in electrical communication with the terminal.

17. The cable terminal and clamp system as recited in claim 9, further comprising at least one resilient element interposed between the cable socket and the cable clamp, the at least one resilient element being configured and arranged to bias the cable socket substantially along the axis defined by the terminal port.

18. The cable terminal and clamp system as recited in claim 17, wherein a force exerted by the resilient member is exerted substantially in the first direction.

19. A cable terminal and clamp system suitable for use in connection with an x-ray generating device, the cable terminal and clamp system comprising:

a cable terminal assembly including a socket having a cable port and a terminal port, each of which defines a corresponding axis, the respective axes being disposed in a non-parallel arrangement relative to each other; and a cable clamp assembly, comprising:

a cable clamp attached to a housing portion of the x-ray device configured to receive at least a portion of the cable socket, and the cable clamp assembly and cable socket being configured and arranged so that motion of the cable socket relative to the cable clamp along a first axis is substantially unimpaired, but motion of the cable socket relative to the cable clamp along a second axis is substantially precluded;

a resilient member interposed between the cable clamp and the cable socket, the resilient member being configured and arranged to exert a force on the cable socket substantially along the first axis so as to bias the cable socket away from the cable clamp;

an indicator that provides visual indication of the position of the cable socket relative to the cable clamp; and a key configured to be at least partially received within a keyway that is oriented substantially along the axis defined by the terminal port of the cable socket, the keyway being defined by at least one of: the cable socket; and, the cable clamp.

20. The cable terminal and clamp system as recited in claim 19, wherein the first axis comprises the axis defined by the terminal port of the cable socket.

21. The cable terminal and clamp system as recited in claim 19, wherein the second axis comprises the axis defined by the cable port of the cable socket.

22. The cable terminal and clamp system as recited in claim 19, wherein the indicator comprises a post attached to the cable socket and slidingly received in a recess defined by the cable clamp.

23. The cable terminal and clamp system as recited in claim 19, wherein the resilient member comprises one of: a spring; and, at least one Belleville washer.

24. The cable terminal and clamp system as recited in claim 19, wherein a force exerted by the resilient member is exerted substantially in the first direction.

25. The cable terminal and clamp system as recited in claim 19, wherein the first and second axes are substantially perpendicular to each other.

26. An x-ray device, comprising:

an evacuated enclosure within which are at least partially disposed a cathode and an anode, the anode including a target surface configured and arranged to receive electrons emitted by the cathode; and a cable terminal and clamp system, comprising:

a cable terminal assembly comprising:

a cable socket having a cable port and a terminal port, each of which defines a corresponding axis;

a terminal attached to the terminal port and in electrical communication with the cathode;

a length of cable at least partially received in the cable port of the cable socket, the length of cable being in electrical communication with the terminal;

a cable clamp assembly including a cable clamp attached to the x-ray device and configured to receive at least a portion of the cable socket, and the cable clamp assembly and cable socket being configured and arranged so that motion of the cable socket relative to the cable clamp along a first axis is substantially unimpaired, but motion of the cable socket relative to the cable clamp along a second axis is substantially precluded; and a key configured to be at least partially received within a keyway that is oriented substantially along the axis defined by the terminal port of the cable socket, the keyway being defined by at least one of: the cable socket; and, the cable clamp.

27. The x-ray device as recited in claim 26, wherein the first axis comprises the axis defined by the terminal port of the cable socket.

28. The x-ray device as recited in claim 26, wherein the second axis comprises the axis defined by the cable port of the cable socket.

29. The x-ray device as recited in claim 26, further comprising an indicator that provides visual indication of the position of the cable socket relative to the cable clamp.

30. The x-ray device as recited in claim 26, further comprising at least one resilient element interposed between the cable socket and the cable clamp, the at least one resilient element being configured and arranged to bias the cable socket along the axis defined by the terminal port of the cable socket.

* * * * *

UNITED STATES PATENT AND TRADEMARK OFFICE

CERTIFICATE OF CORRECTION

PATENT NO. : 7,150,562 B2 
APPLICATION NO. : 10/937150
DATED : December 19, 2006
INVENTOR(S) : Hansen et al.

It is certified that error appears in the above-identified patent and that said Letters Patent is hereby corrected as shown below:

The title page, showing an illustrative figure, should be deleted and substitute therefor the attached title page On the Title Page
Item 73, Assignee, change "Finisar Corporation, Sunnyvale, CA" to --Varian Medical Systems Technologies, Inc., Palo Alto, CA--

Drawings
Sheet 2, replace Fig. 1C with the figure depicted herein below, wherein the terminal has been labeled --106--

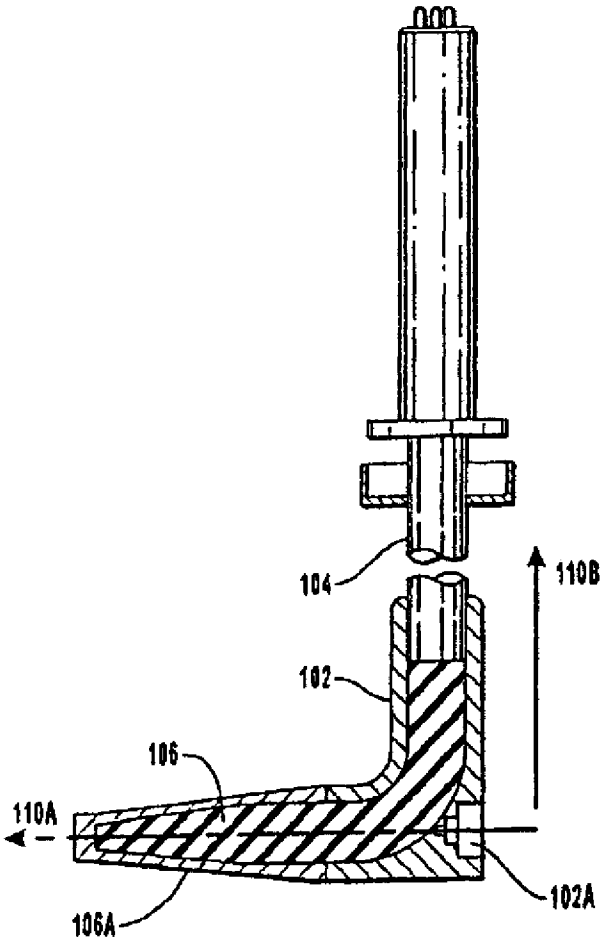

Fig. 1C

UNITED STATES PATENT AND TRADEMARK OFFICE

CERTIFICATE OF CORRECTION

PATENT NO. : 7,150,562 B2 
APPLICATION NO. : 10/937150
DATED : December 19, 2006
INVENTOR(S) : Hansen et al.

It is certified that error appears in the above-identified patent and that said Letters Patent is hereby corrected as shown below:

Drawings

Sheet 11, replace FIG. 7 with the figure depicted herein below, wherein the clamp system has been labeled with --900-- and the "fastener" has been labeled with --501--

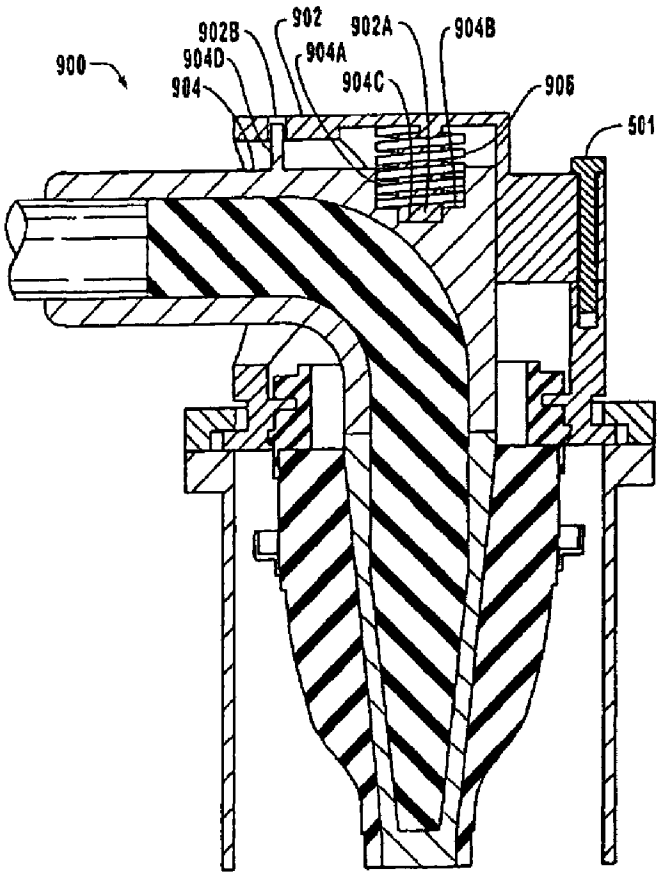

FIG. 7

Column 1

Line 37, before "typically", remove [are]

Column 6

Line 52, change "1" to --1A--

Column 7

Line 48, change "aids" to --aid--

Column 8

Line 16, change "110" to --110A--

UNITED STATES PATENT AND TRADEMARK OFFICE

CERTIFICATE OF CORRECTION

PATENT NO. : 7,150,562 B2
APPLICATION NO. : 10/937150
DATED : December 19, 2006
INVENTOR(S) : Hansen et al.

It is certified that error appears in the above-identified patent and that said Letters Patent is hereby corrected as shown below:

Column 9
Line 3, remove [602A]
Line 6, remove [702A]
Line 7, remove [602A]
Line 7, remove [702A]
Line 8, remove [602A]
Line 9, remove [502]
Line 9, after "received" insert --(see e.g., Figs 1B and 3A-3C)--
Lines 9-10, remove [602A and 702A]
Line 10, remove [502]
Line 63, change "received" to --receives--
Line 65, change "906" to --501--

Column 10
Line 47, remove [602A]
Line 48, remove [702A]
Line 49, remove [502]
Lines 50-51, remove [602A and 702A]
Line 52, remove [502]
Line 53, change " keyways 602A" to --keyways (see e.g., Figs 1B and 3A-3C)--

Signed and Sealed this

Third Day of November, 2009

David J. Kappos

David J. Kappos
*Director of the United States Patent and Trademark Office*

(12) United States Patent
Hansen et al.

(10) Patent No.: US 7,150,562 B2
(45) Date of Patent: Dec. 19, 2006

(54) HIGH VOLTAGE CABLE TERMINAL AND CLAMP SYSTEM

(75) Inventors: Wayne R. Hansen, Centerville, UT (US); Paul G. Christean, Salt Lake City, UT (US); Ricky Smith, Sandy, UT (US)

(73) Assignee: Finisar Corporation, Sunnyvale, CA (US)

( * ) Notice: Subject to any disclaimer, the term of this patent is extended or adjusted under 35 U.S.C. 154(b) by 0 days.

(21) Appl. No.: 10/937,150

(22) Filed: Sep. 9, 2004

(65) Prior Publication Data

US 2006/0050853 A1 Mar. 9, 2006

(51) Int. Cl.
*H05G 1/00* (2006.01)

(52) U.S. Cl. ..... 378/204; 378/121; 439/367

(58) Field of Classification Search ..... 378/101, 378/119, 121, 204; 439/279, 367, 588
See application file for complete search history.

(56) References Cited

U.S. PATENT DOCUMENTS

| | | | | |
|---|---|---|---|---|
| 4,335,928 | A | 6/1982 | Barrett et al. | 439/519 |
| 4,362,348 | A | 12/1982 | Stephenson et al. | 439/258 |
| 4,494,811 | A | 1/1985 | Palermo, Jr. | 439/271 |
| 4,767,961 | A | 8/1988 | Koller et al. | 313/12 |
| 4,799,248 | A | 1/1989 | Furbee et al. | 378/114 |
| 4,806,113 | A | 2/1989 | Rate et al. | 439/190 |
| 5,145,402 | A | 9/1992 | Plyler et al. | 439/459 |
| 5,154,638 | A | 10/1992 | Sireul et al. | 439/611 |
| 5,162,267 | A | 11/1992 | Smyth | 501/45 |
| 5,310,361 | A | 5/1994 | Machowicz et al. | 439/610 |
| 5,358,419 | A | 10/1994 | Pejsa et al. | 439/201 |
| 5,384,820 | A | 1/1995 | Burke | 378/135 |
| 5,553,114 | A | 9/1996 | Siemers et al. | 378/129 |
| 5,707,252 | A | 1/1998 | Meszaros | 439/610 |
| 6,140,582 | A | 10/2000 | Sheehan | 174/65 G |
| 6,198,802 | B1 | 3/2001 | Elliott et al. | 378/119 |
| 6,213,805 | B1 | 4/2001 | Jedlitschka et al. | 439/271 |
| 6,556,654 | B1 * | 4/2003 | Hansen et al. | 378/101 |
| 6,816,574 | B1 | 11/2004 | Hansen | 378/121 |

* cited by examiner

*Primary Examiner*—Courtney Thomas
(74) *Attorney, Agent, or Firm*—Workman Nydegger

(57) ABSTRACT

A cable terminal and clamp system particularly suited for use in an x-ray tube environment. The cable terminal and clamp system includes a cable socket having cable and terminal ports, each of which defines an axis. The cable terminal and clamp system includes a cable clamp that receives at least a portion of the cable socket. The cable clamp and cable socket are configured so that motion of the cable socket, relative to the cable clamp, along the axis defined by the terminal port is unimpaired, while motion of the cable socket, relative to the cable clamp, along the axis defined by the cable port is precluded. A spring interposed between the cable socket and cable clamp biases the cable socket away from the cable clamp along the axis defined by the terminal port. The cable terminal and clamp system thus accommodates thermal expansion of the terminal, while retaining the terminal in an associated receptacle and maintaining alignment of the cable clamp and cable socket.

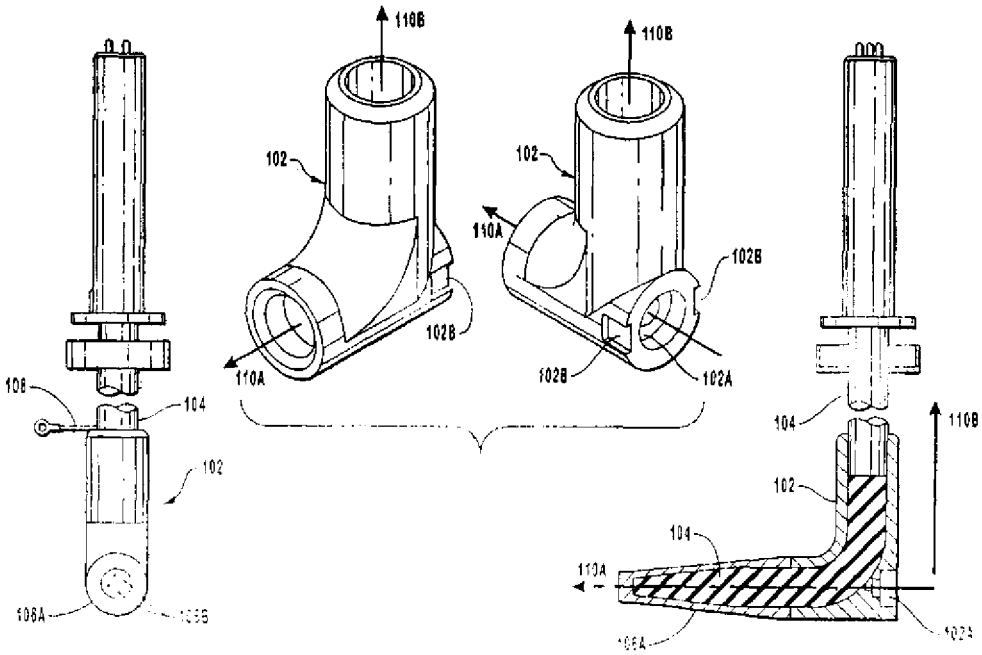

30 Claims, 12 Drawing Sheets